United States Patent [19]

Lillibridge

[11] Patent Number: 4,585,221

[45] Date of Patent: Apr. 29, 1986

[54] ENVELOPE FORMING MACHINE WITH ENVELOPE BLANK STACK SENSOR

[75] Inventor: Harold R. Lillibridge, Burlingame, Calif.

[73] Assignee: American Envelope Company, Chicago, Ill.

[21] Appl. No.: 744,290

[22] Filed: Jun. 12, 1985

Related U.S. Application Data

[63] Continuation of Ser. No. 509,142, Jun. 30, 1983, abandoned.

[51] Int. Cl.[4] ..... B31B 1/06; B31B 3/02; B65H 5/18

[52] U.S. Cl. ..... 271/10; 271/113; 271/165; 271/259; 493/10; 493/27

[58] Field of Search ..... 493/27, 10, 188; 271/10, 165, 258, 259, 113

[56] References Cited

U.S. PATENT DOCUMENTS

| | | | |
|---|---|---|---|
| 892,985 | 7/1908 | Flagg et al. | 493/27 |
| 1,593,827 | 7/1926 | Howard | 493/27 |
| 3,580,141 | 5/1977 | Richter | 493/27 |
| 3,970,384 | 7/1976 | Yamamoto et al. | 355/14 |
| 4,176,941 | 12/1979 | Breitenkam et al. | 355/14 |
| 4,267,009 | 5/1981 | Eddy | 156/538 |

*Primary Examiner*—Francis S. Husar
*Assistant Examiner*—William E. Terrell
*Attorney, Agent, or Firm*—McDougall, Hersh & Scott

[57] ABSTRACT

A machine wherein flat blanks are fed from a stack thereof to be folded and glued into envelopes. The machine is provided with an optical sensing device which is operable to sense when the stack of blanks diminishes to a predetermined height whereupon the machine will be turned off automatically so as to prevent a plurality of blanks from being simultaneously fed into the machine from the diminished stack to jam the machine. The machine operator can then add blanks to the stack and restart the machine. The sensing device can be turned off by the operator in order to run all of the blanks in the stack through the machine at the end of a blank run or at the end of a working day.

1 Claim, 10 Drawing Figures

ENVELOPE FORMING MACHINE WITH ENVELOPE BLANK STACK SENSOR

This application is a continuation of application Ser. No. 509,142, filed June 30, 1983 abandoned.

This invention relates to a machine for forming envelope bodies from precut blanks of paper, which machine feeds the individual blanks from a stack thereof through folding and gluing stations. More particularly, this invention relates to a machine of the character described which includes an optical sensing device which detects the height of the blank stack being fed into the machine and which automatically shuts off the machine if the blank stack diminishes to a predetermined height.

Mailing and other paper envelopes are mass produced by feeding precut paper blanks into machines which fold, glue and form the envelope bodies. These blanks are typically fed into the machines individually from the bottom of a stack of blanks, with the back, side and top flaps being folded in the machine, and with glue being applied by the machine to the side and/or back flaps so that the side and back flaps can be adhered together in the machine to form the envelope body. Glue is then typically applied to the top closure flaps of the formed envelope body in a separate operation.

The stack of envelope blanks is placed in a stack holder at an entry point of the machine, and the individual blanks are fed into the machine from the bottom of the stack. The machines typically operate at high rates of speed so that on the order of 900 blanks per minute can be fed into the machine from the bottom of the stack. The height of the stack of blanks will be on the order of three or four times the height of a readily manually manageable stack of blanks. Thus, before the machine is started up, the operator will load manually three or four handfuls of envelope blanks into the stack holder. The machine is then started and the initial stack is thus diminished or depleted as blanks are fed into the machine. The machine operator must keep watch on the blank stack to make sure that it is never depleted to the extent that a plurality of blanks can be fed into the machine simultaneously, for this unwanted occurrence can jam and sometimes damage the machine. When the height of the stack is maintained above a predetermined level, the weight of the stack will prevent the simultaneous feeding of a plurality of blanks into the machine. Thus, in addition to the other operator tasks connected with operation of the machine, the operator must watch the height of the blank stack and periodically replenish the stack so that it does not fall below the predetermined height.

This invention is directed to improve an envelope folding and gluing machine which incorporates an optical-type sensor, which senses the height of the blank stack and is operable, when the height of the stack falls below a predetermined level, to automatically shut the machine off and concurrently signal to the operator that the stack height has fallen to the undesirably low level. The sensor is mounted on a bracket secured to the machine frame adjacent to the blank stack support. The sensor is preferably positioned downstream of the blank stack and its optical axis is preferable generally parallel to the planes of the individual blanks in the stack. The sensor is electrically connected to a relay and switch box, which is mounted on the operator's side of the machine. The relay and switch box also contains the operator signal, which is preferably in the form of a signal light, which, when lit, signals to the operator that the stack has fallen below the predetermined level, so that the operator will know why the machine has been turned off. The relay and switch box also includes an "on-off" switch which can be manipulated by the operator to shut the sensor off. With the sensor shut off, the entire supply of blanks can be run through the machine under operator observation to ensure that machine does not jam when the last of the blanks are run through it. This run-out of blanks is performed at the end of a run of the particular blanks being used and at the end of a working day. The relay and switch box is electrically connected to a connection box which, in turn, is electrically connected to a machine jam switch and to a power supply for the sensor assembly.

It is, therefore, an object of this invention to provide an improved machine for folding and gluing paper envelope blanks into envelope bodies, which blanks are fed individually into the machine from the bottom of a stack of blanks, and which machine includes an optical sensor which is operable to detect the existence of a minimally acceptable height of a stack of blanks and to automatically shut off the machine when the minimally acceptable stack height occurs.

It is an additional object of this invention to provide an improved machine of the character described wherein a switch is included for turning the optical sensor off and on whereby the sensor can be overridden to allow the entire stack of blanks loaded in the machine to be run through the machine.

It is another object of this invention to provide an improved machine of the character described which includes an operator signal operable to inform the machine operator that the machine has been shut off due to a depleted stack of blanks.

These and other objects and advantages of the invention will become more readily apparent from the following detailed description of a preferred embodiment when taken in conjunction with the accompanying drawings, in which.

Figure 1:
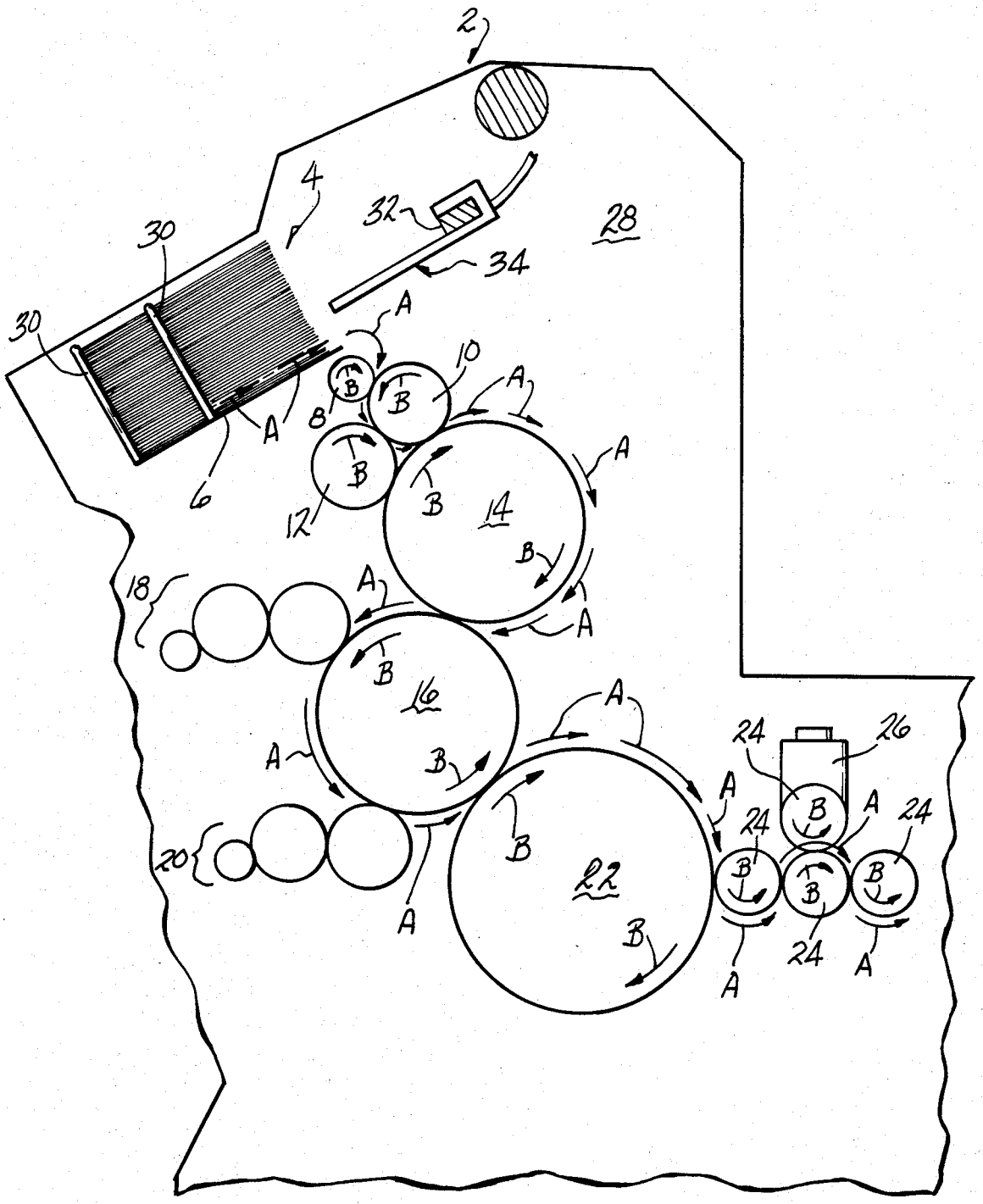
FIG. 1 is a schematic view of the intake portion of the envelope forming machine.

Referring now to the drawings, there is shown in FIG. 1, schematically, the intake portion of an envelope forming machine, denoted generally by the numeral 2, wherein the envelope blanks are fed into the machine serially from the bottom of a stack 4 of the individual blanks. The blanks are fed from the bottom of the stack 4 into a progression of rolls for scoring, printing, cutting and the like. Rotating feeder disks 6 separate the bottom-most blank from the stack 4, whereupon the separated blank moves through the nip of a pressure roll 8 and a feeder cylinder 10. The arrows A, which are positioned externally of the various rolls, indicate the path of movement of the blanks through the rolls. The arrows B, which are positioned within the various rolls, indicate the direction of rotation of the individual rolls which accomplish the blank feeding. The blanks then move between the feeder cylinder 10 and a transfer roll 12 and are thence fed around a pair of impression cylinders 14 and 16 and through a pair of printing stations 18 and 20. The blanks are then fed by a transfer cylinder 22 to a series of guide rolls 24 and through a panel cutting station 26. The various rolls are journalled on a pair of opposed frame members 28 (only one of which is shown). The blank stack is supported by a plurality of feed supports 30, which are also mounted between the frame members 28. Mounted on a strut 32, which extends between the frame members 28, is a bracket 34 on which the sensor is disposed. The bracket 34 is positioned so that the sensor will be directed at a point a predetermined distance above the bottom of the blank stack 4. This distance will be selected so that there will always be enough blanks in the stack 4 to provide enough weight to ensure that the blanks are fed one-by-one off of the bottom of the stack 4. If the stack is allowed to deplete too much, there is a tendency for several blanks to be fed off of the bottom at once, whereby the machine will jam and the cylinders could be damaged.

Figures 2, 3, 4:
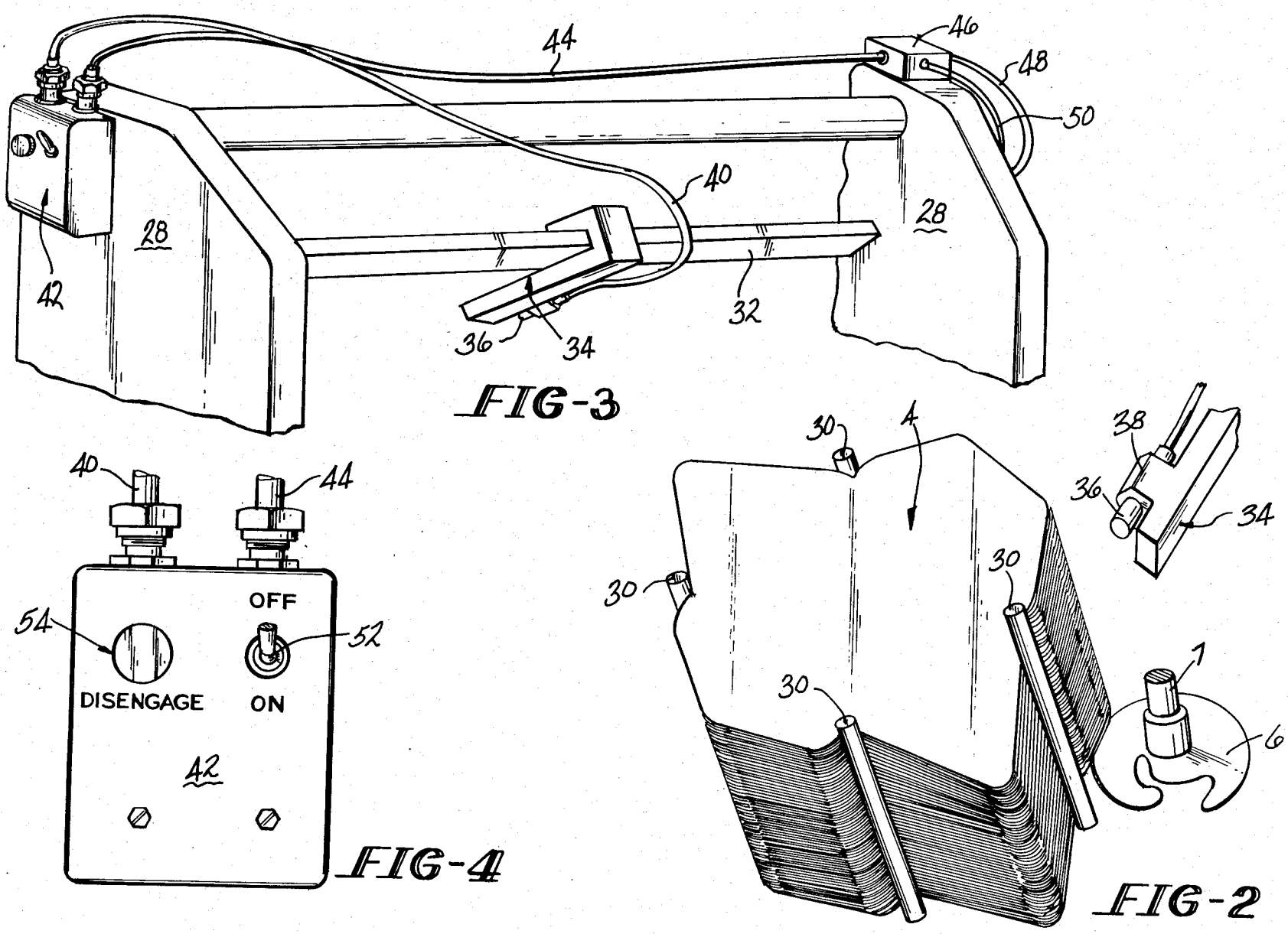
FIG. 2 is a fragmented perspective view of the blank stack showing the position of the sensor relative thereto.
FIG. 3 is a fragmented perspective view of the portion of the envelope forming machine opposite the blank stack and indicating the manner in which the sensor is mounted on the machine relative to the switch box and connection box.
FIG. 4 is a front elevational view of the switch box used in conjunction with the sensor.

Referring now to FIG. 2, the stack area of the machine is shown in a fragmented perspective presentation to clarify the positioning of the sensor 36 on the bracket 34 and to clarify the manner in which the sensor 36 "views" the stack 4. The feeder disks 6 (only one of which is shown) have a helical configuration and rotate about shafts 7 to separate the bottommost blank from the stack 4. It will be understood that the blank supports 30 are inclined to the vertical so that the stack 4 is also inclined to the vertical, as shown in FIGS. 1 and 2. The bracket 34 is formed with a lateral boss 38 which has a through bore in which the sensor 36 is telescopingly received. The sensor 36 is a photoelectric sensor, preferably a Cutler Hammer Model E 58CAL18A2D2 of the diffuse reflective type. As previously noted, the sensor 36 is focused on a point upwardly offset from the bottom of the stack 4 and so long as light from the stack is reflected back into the sensor 36, which indicates that the height of the stack 4 is above the focus point, the machine will keep running. If the stack height should drop below the focus point, no light will be reflected back into the sensor 36 and the machine operator will be alerted automatically to this fact. The signal can be made in a variety of ways, as by an audible alarm, a visual signal, or the machine can be turned off automatically, or a combination of the aforesaid. In the preferred embodiment herein described, a visual signal is displayed and the machine is shut down automatically.

Referring now to FIG. 3, the obverse side of the machine is shown. The sensor 36 is connected by a cable 40 to a switch box 42 which is mounted on one of the frame members 28. A second cable 44 extends from the switch box 42 to a connection box 46, which is mounted on the opposite frame member 28. A power cable 48 extends from the connection box 46 to a power source (not shown), and a line 50 extends from the connection box 46 to a jam sensor (not shown) which is included in the machine to shut the latter down should a jam of blanks occur in the machine.

Referring now to FIG. 4, the exterior of the switch box 42 is shown. The box 42 is fitted with an off-on switch 52, which operates off of the power cable 44. Also mounted in the box 42 is a warning light 54, which operates off of the sensor cable 40.

Figure 5:
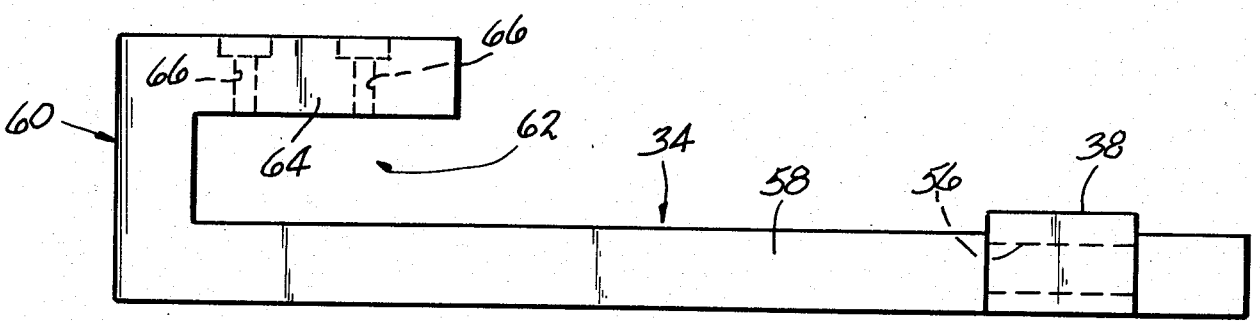
FIG. 5 is a side elevational view of the bracket used to mount the sensor on the machine.
Figure 6:
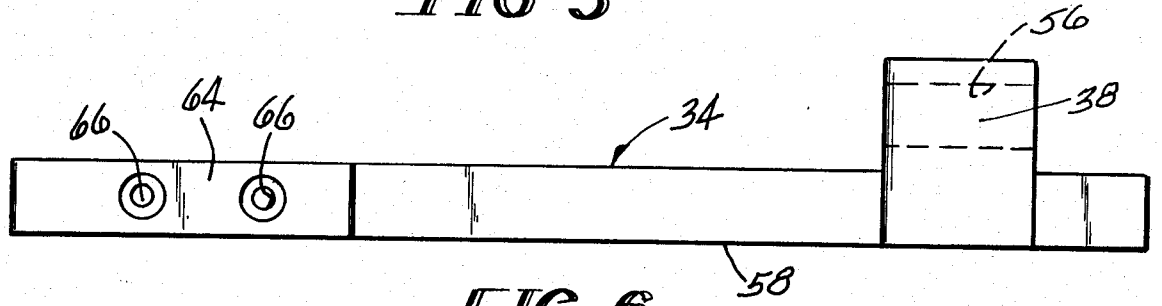
FIG. 6 is a top plan view of the bracket of FIG. 5.
Figure 7:
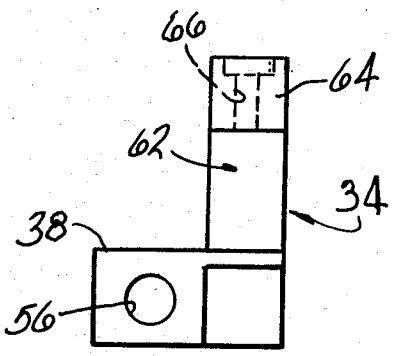
FIG. 7 is an end elevational view of the bracket of FIGS. 5 and 6.

FIGS. 5–7 show the detailed construction of the sensor bracket 34. As previously noted, the bracket 34 includes a laterally projecting boss 38 in which the sensor is mounted. The boss 38 is provided with a through bore 56 in which the sensor is telescopingly received. The bracket 34 is formed with an elongated mid-portion 58 and a rear terminal U-shaped portion 60 which forms a clevis 62 adapted to be fitted onto the strut 32 on the machine. The leg 64 of the U-shaped portion 60 is provided with a pair of threaded bores 66 operable to receive set screws to secure the bracket 34 in place on the machine strut 32.

Figure 8:
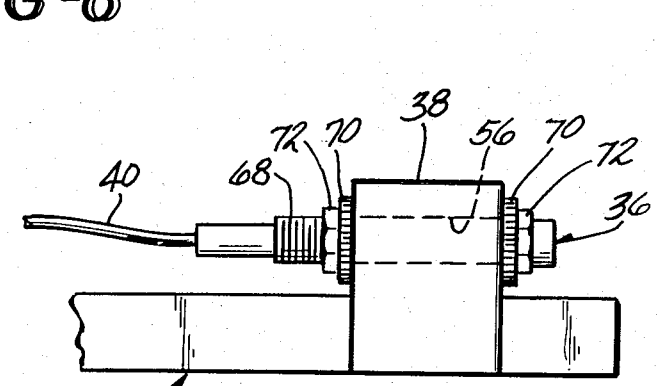
FIG. 8 is a fragmented top plan view of the bracket of FIGS. 5–7 showing the sensor mounted therein.

Referring now to FIG. 8, the manner in which the sensor 36 is mounted on the bracket 34 is more clearly shown. It will be noted that the sensor 36 has a threaded outer surface 68, which extends through the bore 56 in the bracket boss 38. Once in place on the bracket 34, lock nuts 70 and 72 are used to secure the sensor 36 to the bracket 34.

Figure 9:
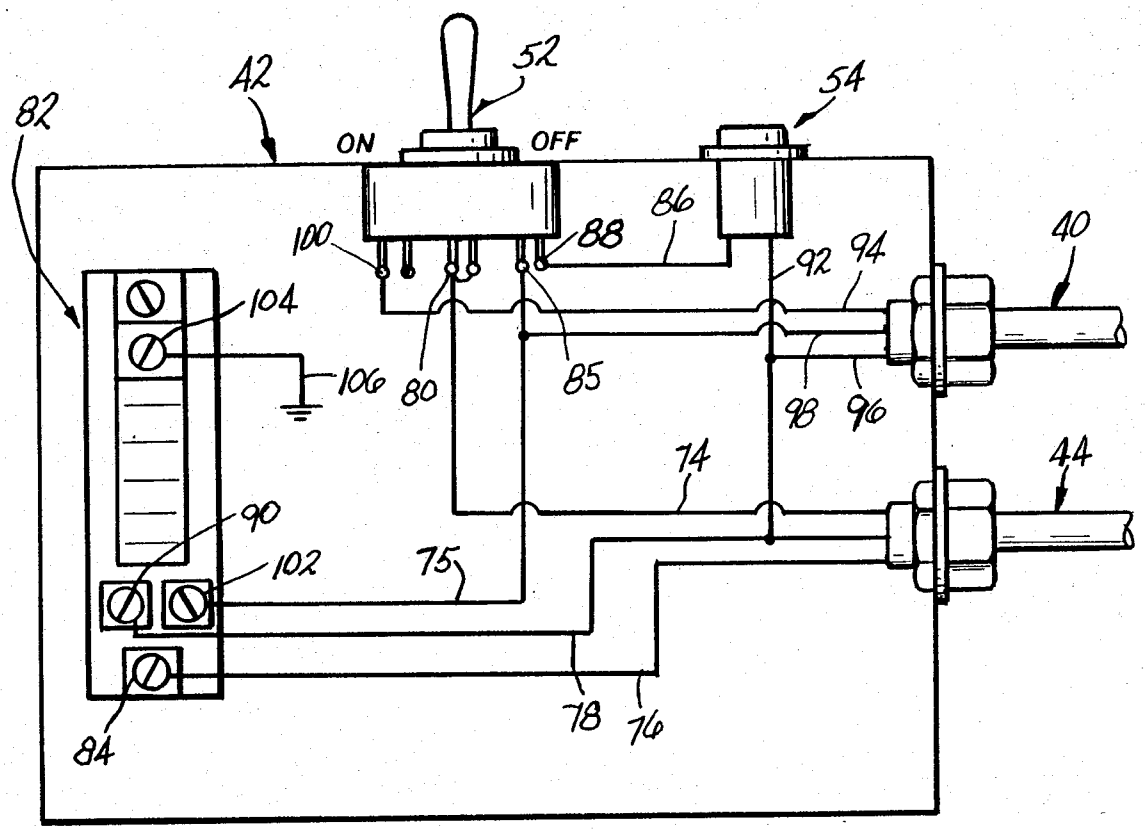
FIG. 9 is a schematic view of the electrical circuitry in the switch box.

Referring now to FIG. 9, the electrical circuitry in the switch box 42 is shown. The power cable 44 carries three wires 74, 76 and 78. The wires 74 and 78 are connected to a 115 Volt A.C. power source externally of the box 42, and the wire 76 is connected to the blank jam sensor on the machine. The wire 74 is connected to the switch 52 at contact 80 and the jam sensor wire 76 is connected to relay 82 at contact 84. The switch 52 is connected to the signal light 54 by wire 86 through contact 88. The signal light 54 is also connected to relay 82 at contact 90 through wire 92. The stack sensor cable 40 carries three wires 94, 96 and 98. The wire 94 is connected to switch 52 at contact 100, and the wire 96 is connected to relay 82 at contact 90. The wire 78 from power cable 44 is connected to wire 92 and wire 96 from the stack sensor cable 40. Wire 98 is connected to relay 82 at contact 102 and to switch 52 at contact 85. The switch contact 85 is also connected to relay contact 102 via wire 75. The relay 82 includes contact 104, which is connected to ground wire 106.

Figure 10:
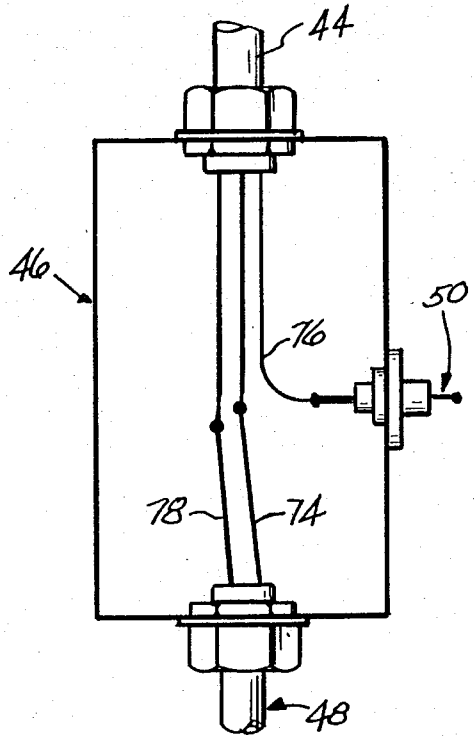
FIG. 10 is a schematic view of the electrical circuitry in the connection box.

Referring now to FIG. 10, the electrical circuitry contained in the connection box 46 is shown. The wires 74 and 78 pass from the cable 44 through the connection box 46 and into the cable 48, which is connected to the 110 Volt A.C. power source. The wire 76 passes from the cable 44 through the box 46 to the cable 50, which is connected to the blank jam sensor light (not shown) on the machine.

The machine operates as follows. The operator places a stack of blanks in the blank supports 30 so that the latter are substantially filled, places the switch 52 in the "on" position and turns the machine on. As the blanks in the stack are depleted by being fed into the machine, the operator adds more blanks to the top of the stack so that the top of the stack does not fall below the level of the sensor 36. With the switch 52 in the "on" position, the signal light 54 will not light up so long as the top of the blank stack stays above the level of the sensor 36. If, for some reason, as, for example, operator inattention or the like, the level of the top of the blank stack falls below the level of the sensor 36, this condition will be sensed, the machine jam sensor light (not shown) will go on and the machine will be shut off automatically and concurrently. When this condition becomes known to the operator, the condition of the jam sensor light is observed, thereby alerting the operator to the fact that the machine was shut off because of excessive depletion of the number of blanks in the stack. The operator then replenishes the supply of blanks in the stack, and the jam sensor signal light will automatically go off again. The operator must then restart the machine as the latter will not restart itself once stopped by the sensor. In the event that the operator desires to run all of the blanks through the machine, as is done at the end of size run, or at the end of a working day, he will turn the switch 52 to the "off" position to deactivate the sensor 36. This will cause the signal light 54 to light up and will allow the entire stack of blanks to be run through the machine under close supervision of the operator.

The machine of this invention thus provides an automatic means for shutting down the machine in the event of excessive depletion of blanks in the stack. This shutdown will prevent jamming of the machine which may occur from multiple feeding of blanks, resulting from inadequate weight of blanks in the depleted stack. At the same time, should the operator desire to intentionally run all of the blanks in the stack through the machine, the shut down sensor can be deactivated and machine run-out can be performed.

Since many changes and variations of the disclosed embodiment of the invention may be made without departing from the inventive concept, it is not intended to limit the invention otherwise than as required by the appended claim.

What is claimed is:

1. An apparatus for feeding flat blanks from a stack thereof into a forming machine, said apparatus comprising:

(a) support means for supporting a stack of blanks;

(b) feed means disposed below said support means and operable to engage the lowermost blank in the stack to feed individual blanks from the bottom of the stack thereby depleting the blanks in the stack to lower the height of the stack;

(c) an optical sensor mounted on said machine and focused on a point a predetermined distance above the bottom of the stack so as to sense when the stack is depleted to a level below said point of focus;

(d) an electrical power source;

(e) an electrical switch electrically connected to said power source and to said optical sensor, said switch being operable in a first mode to electrically connect said power source to said optical sensor to activate the latter, and operable in a second mode to electrically disconnect said power source from said optical sensor to deactivate the latter whereby said machine will continue to operate after the stack has been depleted to a level below said point of focus;

(f) means for discontinuing operation of the machine in the event of a jam, the discontinuing means being connected to the optical sensor, and the discontinuing means being operable by the optical sensor only when the electrical switch is in the first mode; and (g) a signal light connected to said electrical source via said electrical switch, said electrical switch being operable to energize said signal light when said switch is in one of said modes whereby said signal light provides an indication of the state of said optical sensor.

* * * * *